US008756967B2

(12) United States Patent
Jaubert

(10) Patent No.: US 8,756,967 B2
(45) Date of Patent: Jun. 24, 2014

(54) BENDING MACHINE FOR THE PRODUCTION OF BENT PROFILE SECTIONS, IN PARTICULAR FOR EXCHANGER TUBES

(75) Inventor: Philippe Jaubert, Cologne (FR)

(73) Assignee: Eaton Leonard Europe, Cologne (FR)

( * ) Notice: Subject to any disclaimer, the term of this patent is extended or adjusted under 35 U.S.C. 154(b) by 260 days.

(21) Appl. No.: 13/260,522

(22) PCT Filed: Mar. 19, 2010

(86) PCT No.: PCT/FR2010/000231

§ 371 (c)(1),
(2), (4) Date: Sep. 26, 2011

(87) PCT Pub. No.: WO2010/116052

PCT Pub. Date: Oct. 14, 2010

(65) Prior Publication Data

US 2012/0024036 A1 Feb. 2, 2012

(30) Foreign Application Priority Data

Apr. 7, 2009 (FR) ..... 09 01694

(51) Int. Cl.
*B21D 7/024* (2006.01)
*B21D 7/04* (2006.01)

(52) U.S. Cl.
USPC ..... 72/218; 72/149; 72/155; 72/156; 72/214; 72/217; 72/369

(58) Field of Classification Search
USPC ..... 72/149, 152, 153, 154, 157, 158, 166, 72/167, 214, 215, 216, 217, 218, 362, 369, 72/482.7
See application file for complete search history.

(56) References Cited

U.S. PATENT DOCUMENTS

| | | | | | |
|---|---|---|---|---|---|
| 4,130,004 | A * | 12/1978 | Eaton | ..... | 72/151 |
| 5,339,670 | A * | 8/1994 | Granelli | ..... | 72/152 |
| 7,743,636 | B2 * | 6/2010 | Rusch | ..... | 72/149 |
| 8,141,403 | B2 * | 3/2012 | Gemignani et al. | ..... | 72/215 |

FOREIGN PATENT DOCUMENTS

| | | | |
|---|---|---|---|
| DE | 201 12 142 | U1 | 11/2001 |
| EP | 0 899 033 | A2 | 3/1999 |
| JP | 2003-266127 | A | 9/2003 |

* cited by examiner

*Primary Examiner* — David B Jones
(74) *Attorney, Agent, or Firm* — Birch, Stewart, Kolasch, & Birch, LLP

(57) ABSTRACT

The invention relates to a bending machine for the production of bent profile sections, in particular for exchanger tubes, including a frame on which an articulated arm is mounted consisting of a rotatably fixed arm capable moving along a transverse axis of movement, and a rotary arm supported by a rotary shaft and having a means for attaching a clamping jaw, a means for mounting either a freely rotating roller or a clamping shape rotatably secured about said rotary shaft on the rotary shaft of the articulated arm, driving rollers distributed in two series and positioned on either side of a bending axis, and a means for actuating said driving rollers for synchronously rotating the latter.

20 Claims, 13 Drawing Sheets

Figure 1:
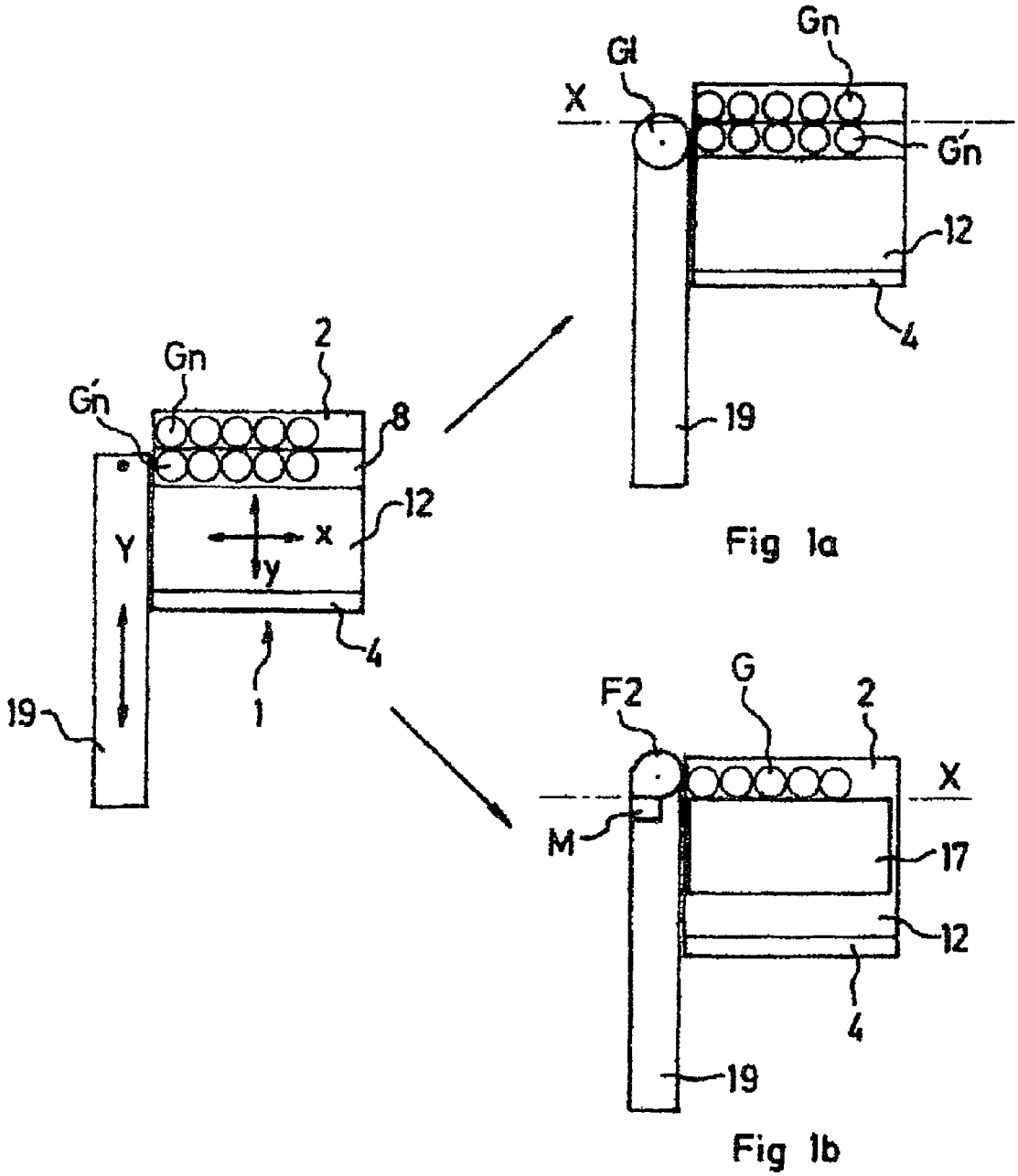

BENDING MACHINE FOR THE PRODUCTION OF BENT PROFILE SECTIONS, IN PARTICULAR FOR EXCHANGER TUBES

The invention relates to a bending machine for the production of bent profile sections, in particular for exchanger tubes, comprising a frame on which are mounted means for holding the profile section along a longitudinal axis of movement (x), and means for bending the said profile section.

The manufacture of heat exchangers, in particular industrial heat exchangers, especially in the energy sector and more particularly in the nuclear field, calls for the fabrication of a multitude of generally U-shaped tubes of which the bend radii extend over a wide range of values generally comprised between 50 mm and 2500 mm. A conventional nuclear exchanger is thus composed of 300 to 500 tubes presenting about fifty different bend radii.

At the present time, given this range of bend radii and in order to meet requirements in particular for precision and finish quality essential in the nuclear field, bending of the tubes calls for the application of two different bending techniques each dedicated to a different given range of bend radius values.

Thus, for small bend radii (radii less than 10 times the diameter of the tubes), the technique used is that of bending by winding involving the use of a bending machine in which the bending head is rotatable about a bending axis and includes a clamping form centred on the bending axis and a clamping jaw provided with bearing surfaces between which the profile section to be bent is passed, clamped and then wound.

For bend radii of higher values (radii greater than 10 times the diameter of the tubes), the technique used is that of bending by rolling or pushing involving the use of a bending machine in which the bending head includes a freely rotating roller to which the tubes are fed by means of drive rollers arranged in two series positioned on either side of the longitudinal axis of movement (x).

Therefore, at the present time, the bending of nuclear heat-exchanger tubes not only requires two separate bending machines but also requires two complete bending installations each including in particular a loading and feeding system and an unloading system.

Given the lengths of the tubes to be bent, which measure in the order of 4 m to 30 m, each of these installations necessarily extends over a large area (more than 1000 $m^2$) and entails considerable cost (equipment plus infrastructure). Moreover, this solution results in a doubling of operating costs (production, maintenance, etc.).

The present invention seeks to overcome these drawbacks and has as its principal object the provision of a bending machine able to produce a very wide range of bend radii and capable in particular of producing the full range of bent U-profiles required for the manufacture of industrial heat exchangers, especially in the nuclear field.

A further object of the invention is to provide a bending machine capable of providing accurate information about the exact position of the profile during bending.

To this end, the invention discloses a bending machine for the production of bent profile sections, in particular exchanger tubes, in which the bending means include:

an articulated arm composed of two arms: a rotatably fixed arm and a rotary arm articulated with respect to the said rotatably fixed arm about a rotary shaft extending along an axis of rotation (z) orthogonal to the axis of movement (x):

the rotatably fixed arm being mounted on the frame via means for moving the articulated arm along an axis of transverse movement (y) perpendicular to the plane (x, z), adapted to adjust the position of the axis of rotation (z) relative to that of the longitudinal axis (x), and the rotary arm being provided with means for attaching a clamping jaw carried by means for translational movement of the said clamping jaw relative to the axis of rotation (z), along an axis perpendicular to the said axis of rotation, between a position nearer to the axis of rotation (z), for clamping and winding the profile to be bent, and a position further away from the axis of rotation (z), for introducing a profile to be bent, means for rotatably driving the rotary shaft of the articulated arm, about the axis of rotation (z), means for mounting on the rotary shaft of the articulated arm either a roller freely rotatable relative to the said rotary shaft, or a clamping form rotatably fixed relative to the said rotary shaft, adapted to cooperate with the clamping jaw, means for translationally entraining and guiding a profile section along the longitudinal axis (x) including driving rollers, means of mounting the driving rollers adapted so as to distribute them into two series positioned on either side of the longitudinal axis (x), and including means for translationally moving one of the said series, known as the mobile series, of driving rollers along an axis perpendicular to the longitudinal axis (x), between a position for clamping and entraining a profile to be bent between the two series of driving rollers, and a position for introducing a profile to be bent between said series of driving rollers, and, integral with the frame, means for actuating the driving rollers adapted to rotatably actuate the latter synchronously in their position for clamping and entraining a profile to be bent.

The invention has therefore sought to combine the two bending techniques currently used in an inventive manner to produce U-shaped heat-exchanger tubes, so as to provide a single bending machine capable of selectively putting into effect either the bending technique by winding or the bending technique by rolling or pushing, thereby making it possible to produce a very wide range of bending radii.

It will also be noted that the bending angle may be different from 180 degrees, and that in the case of a 180 degree angle, the bending machine is also capable of producing profile sections in the shape of a "flat bottom U" having a rectilinear web connected to each of the two branches of the U by a 90 degree bend.

According to the design of the bending machine of the invention, the bending technique by winding can be put into effect with a positioning of the axis of rotation (z) in alignment with the axis of movement (x), using a clamping form rotatably driven by the rotary shaft of the articulated arm and cooperating with a clamping jaw, and guiding the profiles along the axis of movement (x).

The bending technique by rolling or pushing can in turn be put into effect by means of a freely-rotating roller mounted on the rotary shaft, positioned so that the said freely-rotating roller deforms, by an amount depending on the programmed bending radius, a profile section entrained longitudinally by the motorised driving rollers.

Overall, therefore, such a bending machine results in a halving of all costs (infrastructure, installation, operation, etc.) compared with the costs associated with the bending machines routinely used at the present time to produce U-tubes for heat exchangers.

It will be noted that, according to the invention, when performing a bending by winding operation, guidance of the profile sections can be accomplished by means of the driving rollers either by providing a "disengaged" mode for the motorised drive mechanism of the latter, or by setting a rotational speed synchronised with the speed of rotation of the clamping form.

However, advantageously according to the invention, the bending machine includes:

means for guiding the profile sections along the longitudinal axis (x), adapted to cooperate with a clamping form carried by the rotary shaft of the articulated arm and a clamping jaw carried by the rotating portion of the said articulated arm, and including a rail having a longitudinal bearing surface for guiding a profile section, and means for mounting the rail on the frame including means for translationally moving the latter along a longitudinal axis parallel to the axis (x).

By thus providing controlled movement of the rail it is possible to "accompany" and guide the profile section so as to compensate for effacement by rotation of the clamping jaw, thereby reducing the effects of thinning of the upper surface and ovalisation of the profile sections.

According to another advantageous embodiment of the invention, the means for translationally moving the mobile series of rollers include a platen mounted on the frame via means for moving the said platen along an axis perpendicular to the longitudinal axis (x), whereon are disposed means for mounting the rail adapted to position the latter in the same plane as that in which the driving rollers lie.

Such an arrangement makes it possible to simplify the means of mounting the rail which are thus supported by the platen supporting the series of mobile driving rollers. Furthermore, by virtue of this arrangement, the planes of bending are identical irrespective of the bending method used, i.e. winding or rolling, so that no height adjustment is required in particular for feeding and removing the profile sections during the changeover from one bending method to the other.

According to another advantageous embodiment of the invention, the means for actuating the driving rollers include two series of gears rotatably mounted on the frame, and means for rotatably driving the said gears in synchronism.

In addition, the means for mounting the rail are then advantageously adapted to position the latter so that it extends partially above the gears actuating the mobile series of rollers, after dismounting the said mobile series of driving rollers.

Furthermore, the means for attaching a clamping jaw on the rotary portion of the articulated arm advantageously include a mounting plate provided with members for indexing the position of the said clamping jaw, means for translationally moving the clamping jaw relative to the axis of rotation (z) including a toggle joint system connecting the mounting plate to the rotary portion of the articulated arm.

According to another advantageous characteristic of the invention, the bending machine includes a codewheel for determining the length of advancement of the profile sections, associated with a sensor for detecting the end of the said profile sections. Such a codewheel makes it possible to determine the exact position of the profile section as it is being bent, and in particular to control the advance of the said profile section in relation to the said position information.

The bending machine according to the invention also includes, advantageously, a feeder unit disposed upstream of the frame and comprising two profile entrainment rollers, and opening means capable of moving the said rollers between a position for clamping and entraining a profile section to be bent and a position for introducing a profile section to be bent between the said rollers.

Figure 2:
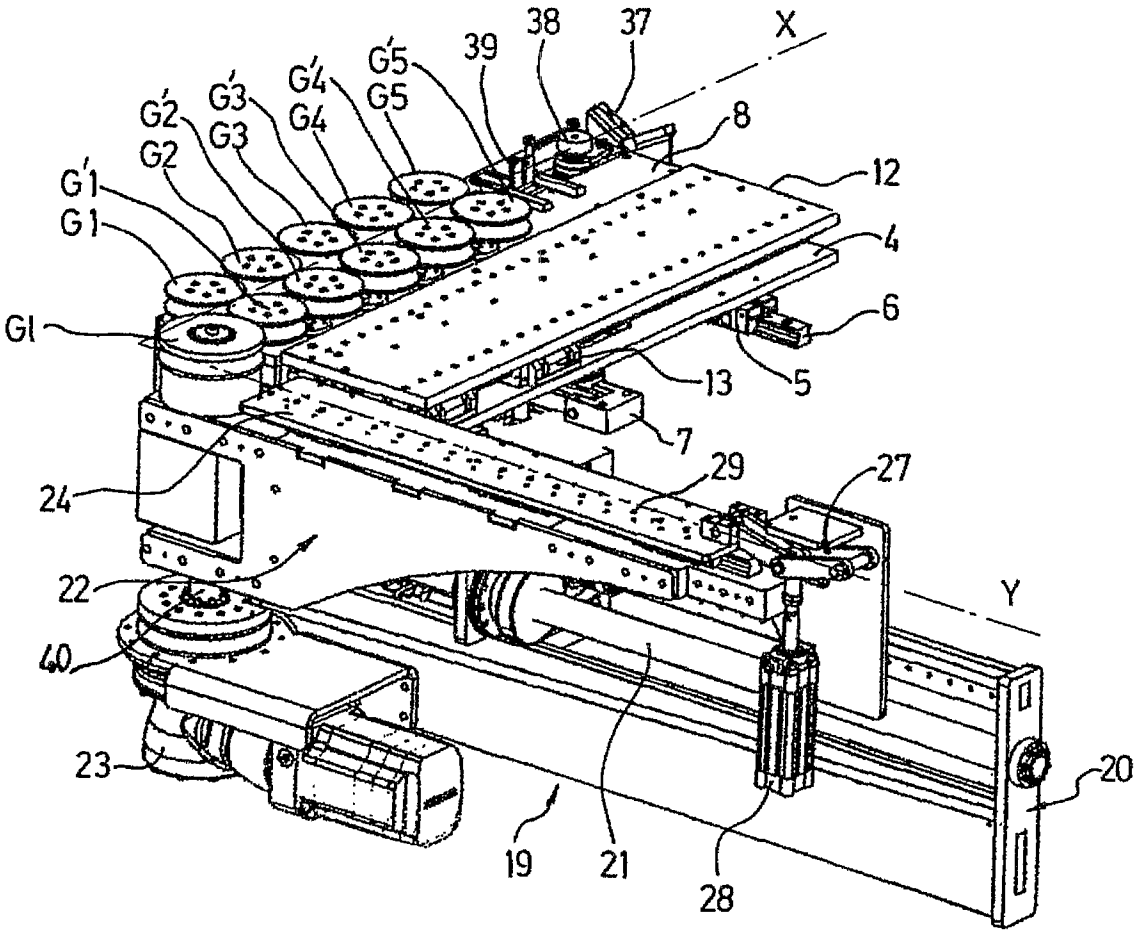
Figure 3:
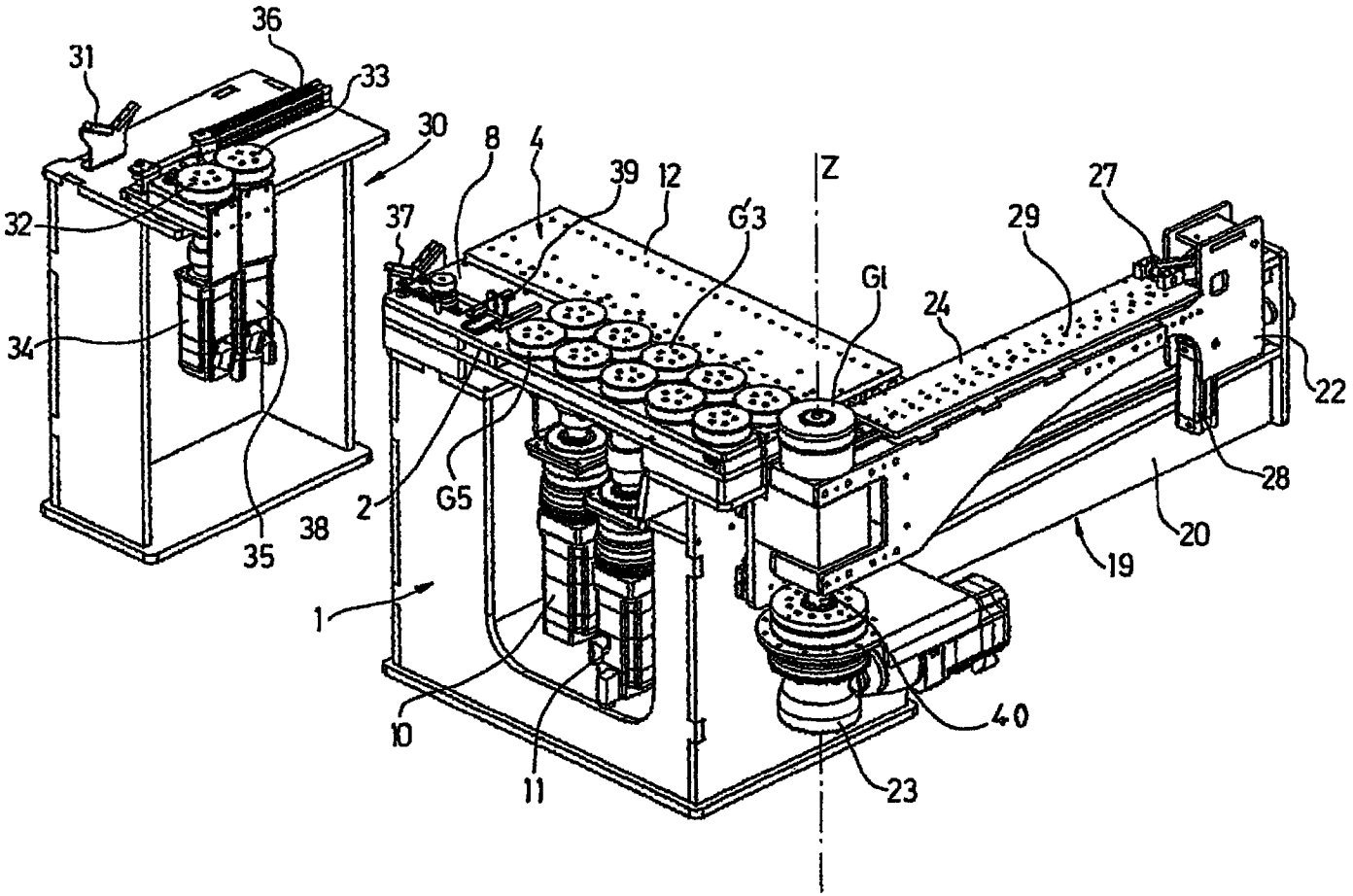
Figure 4:
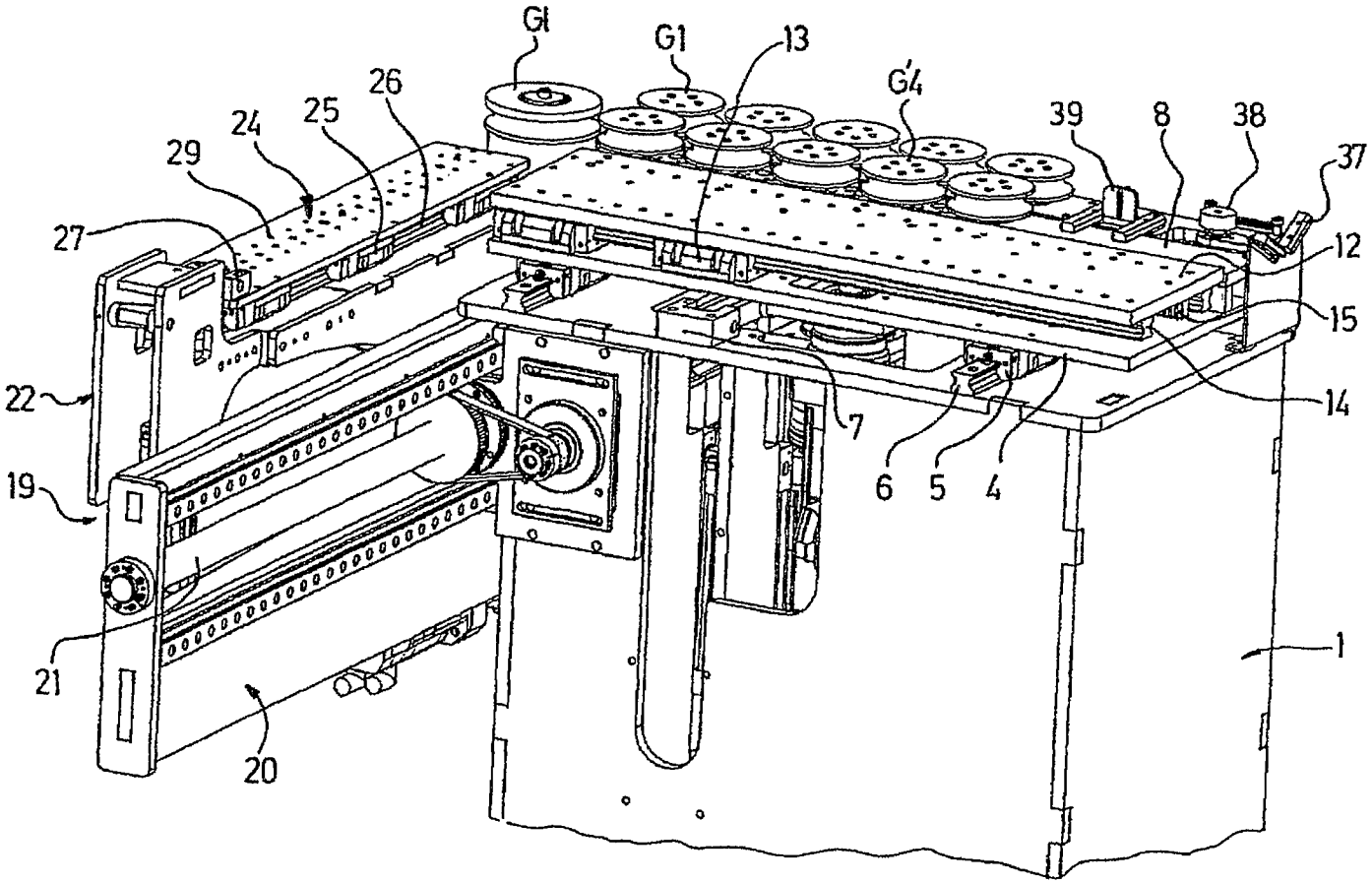
Figure 5:
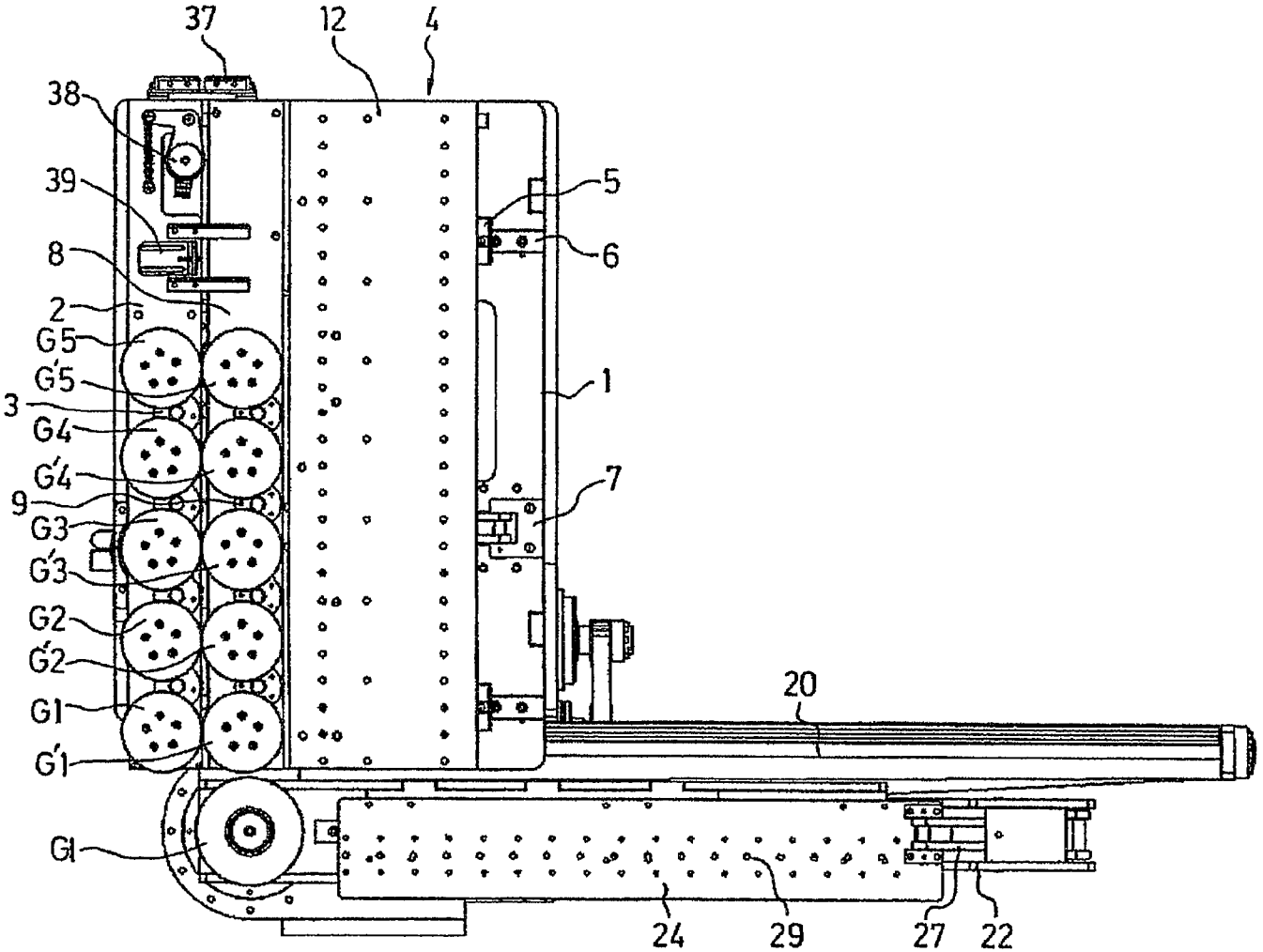
Figure 6:
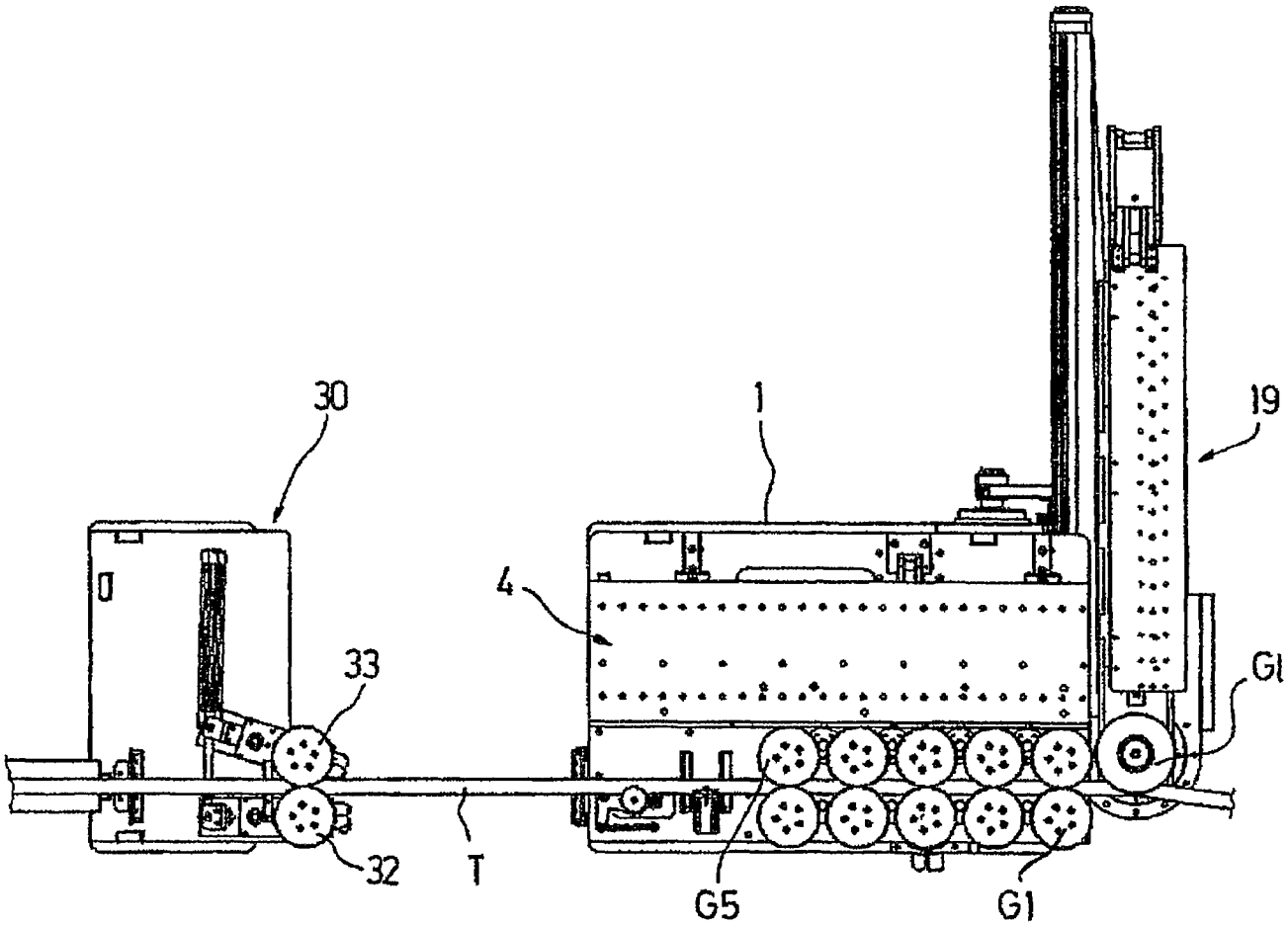
Figure 7:
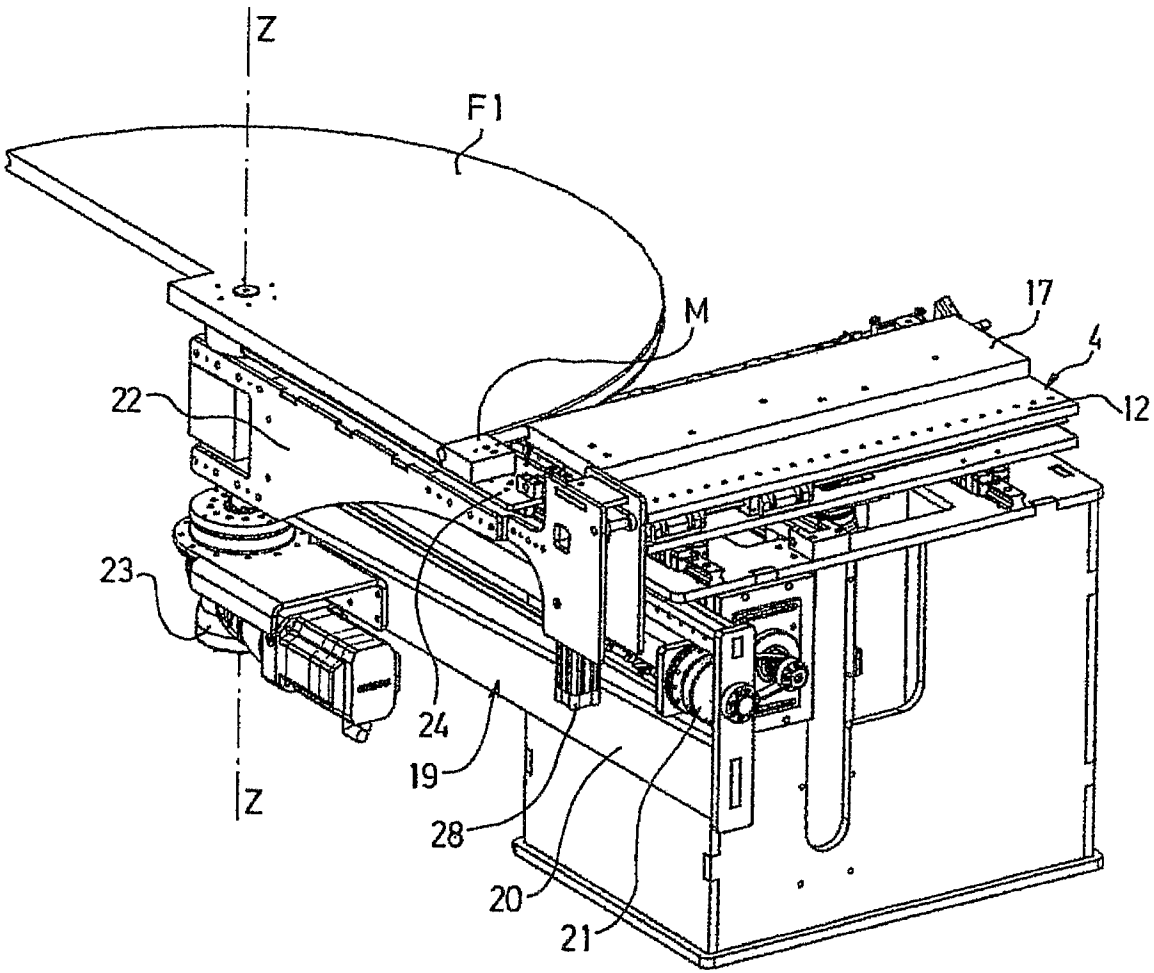
Figure 8:
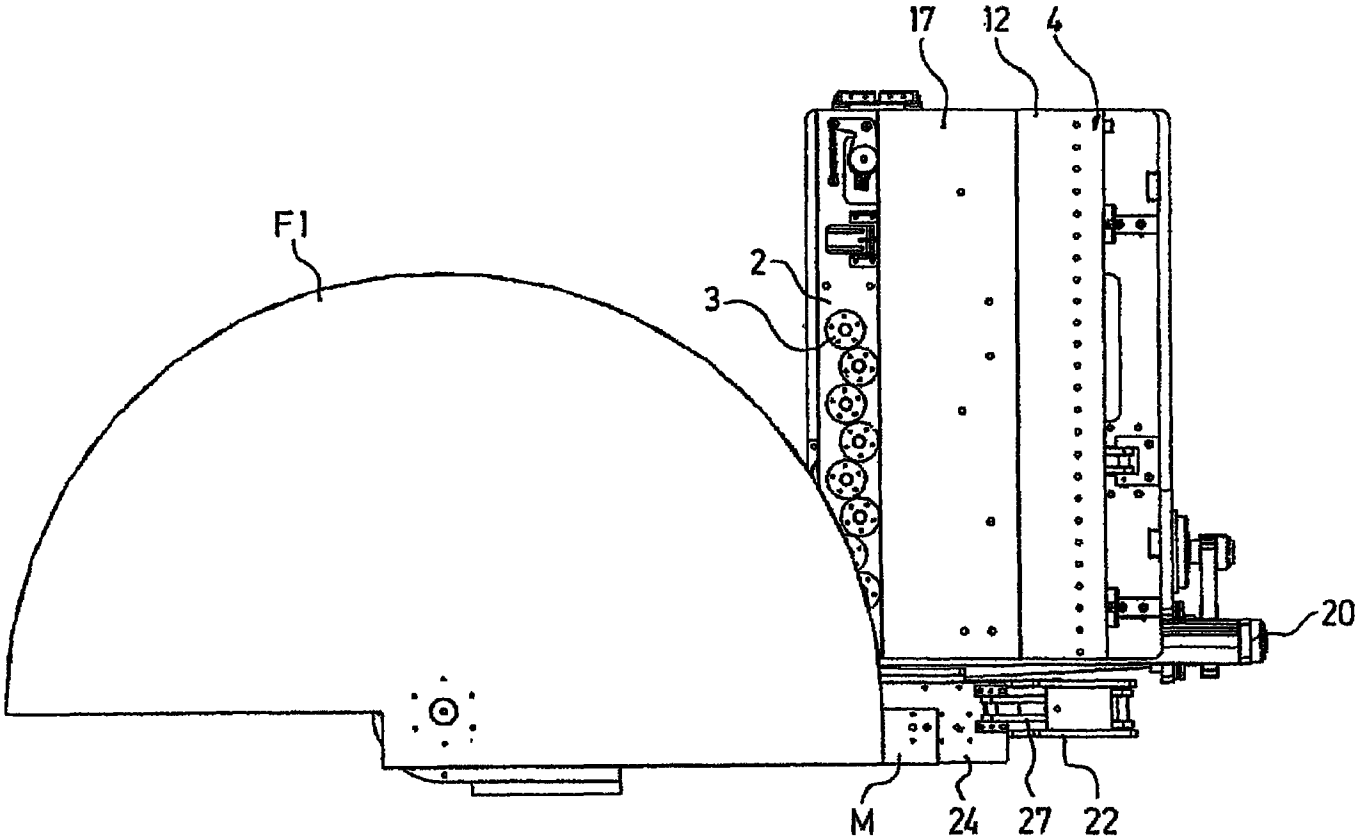
Figure 9:
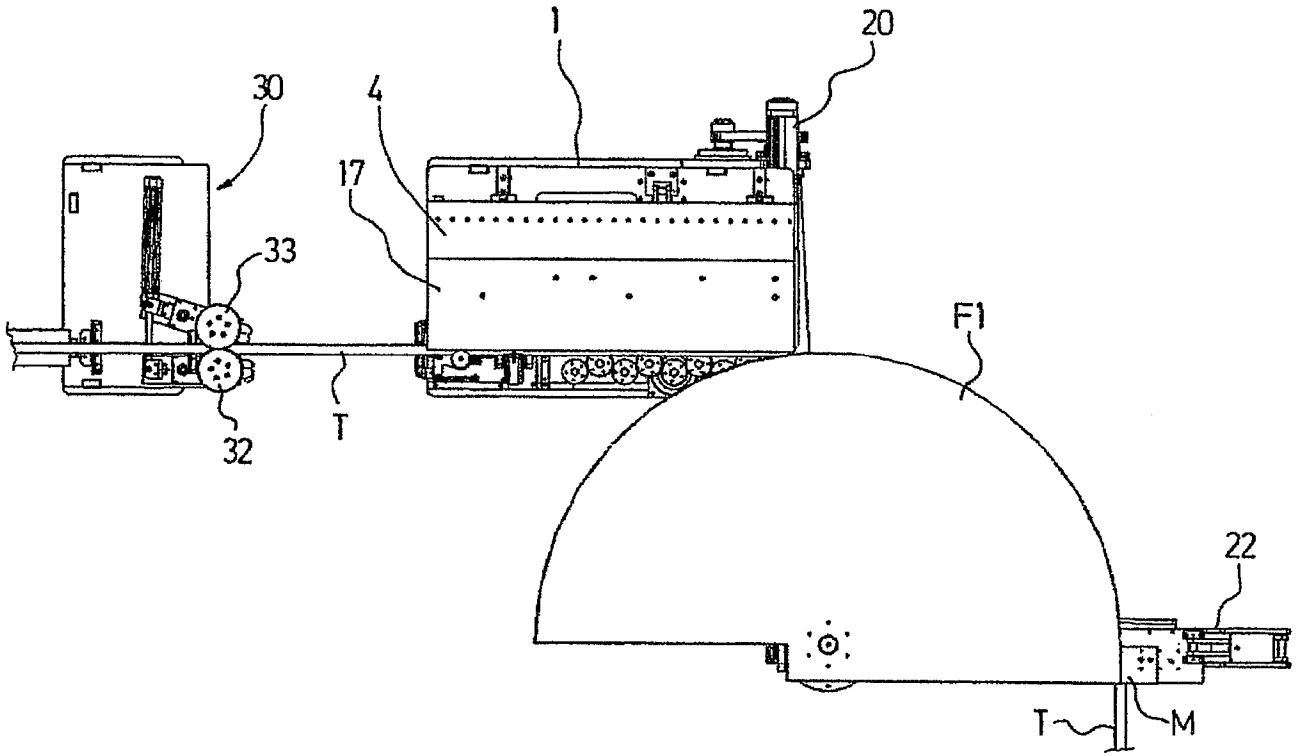
Figure 10:
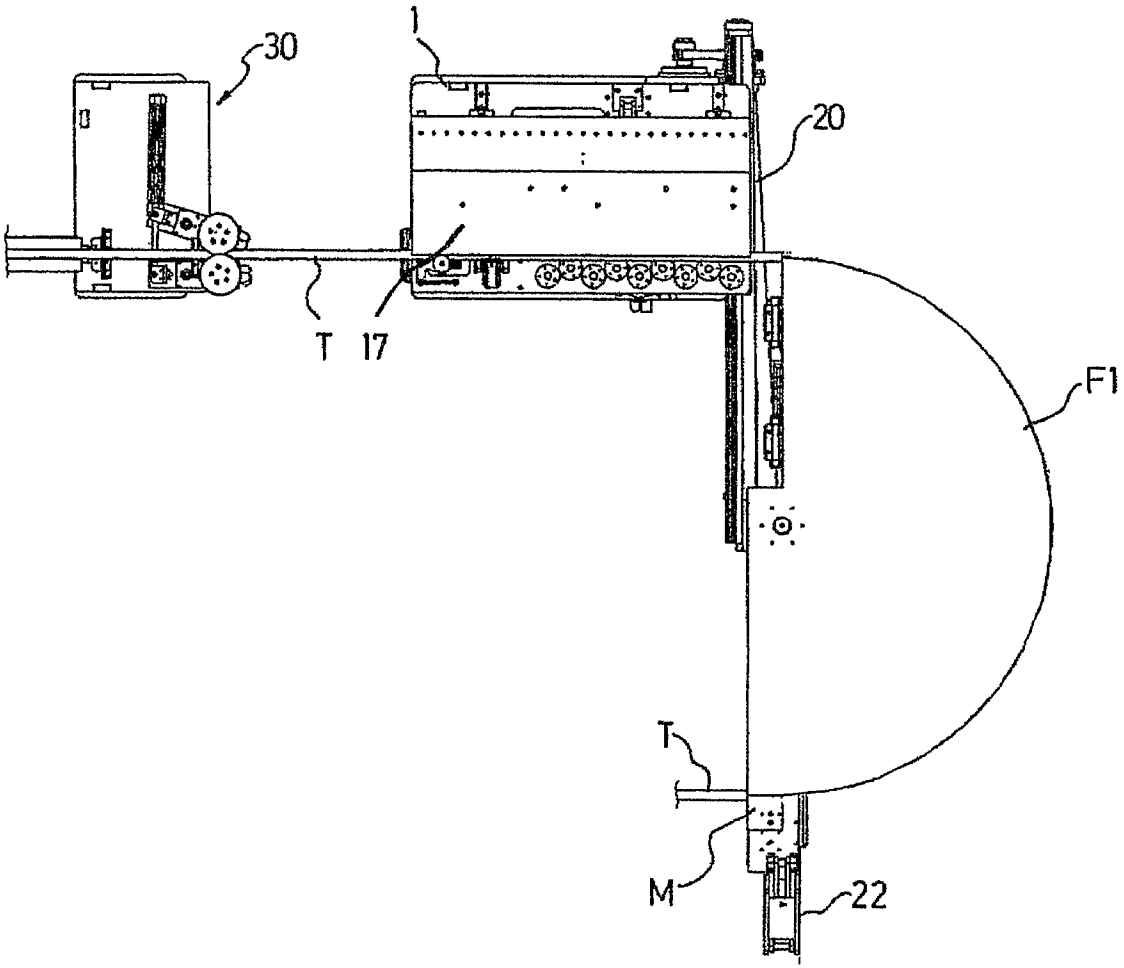
Figure 11:
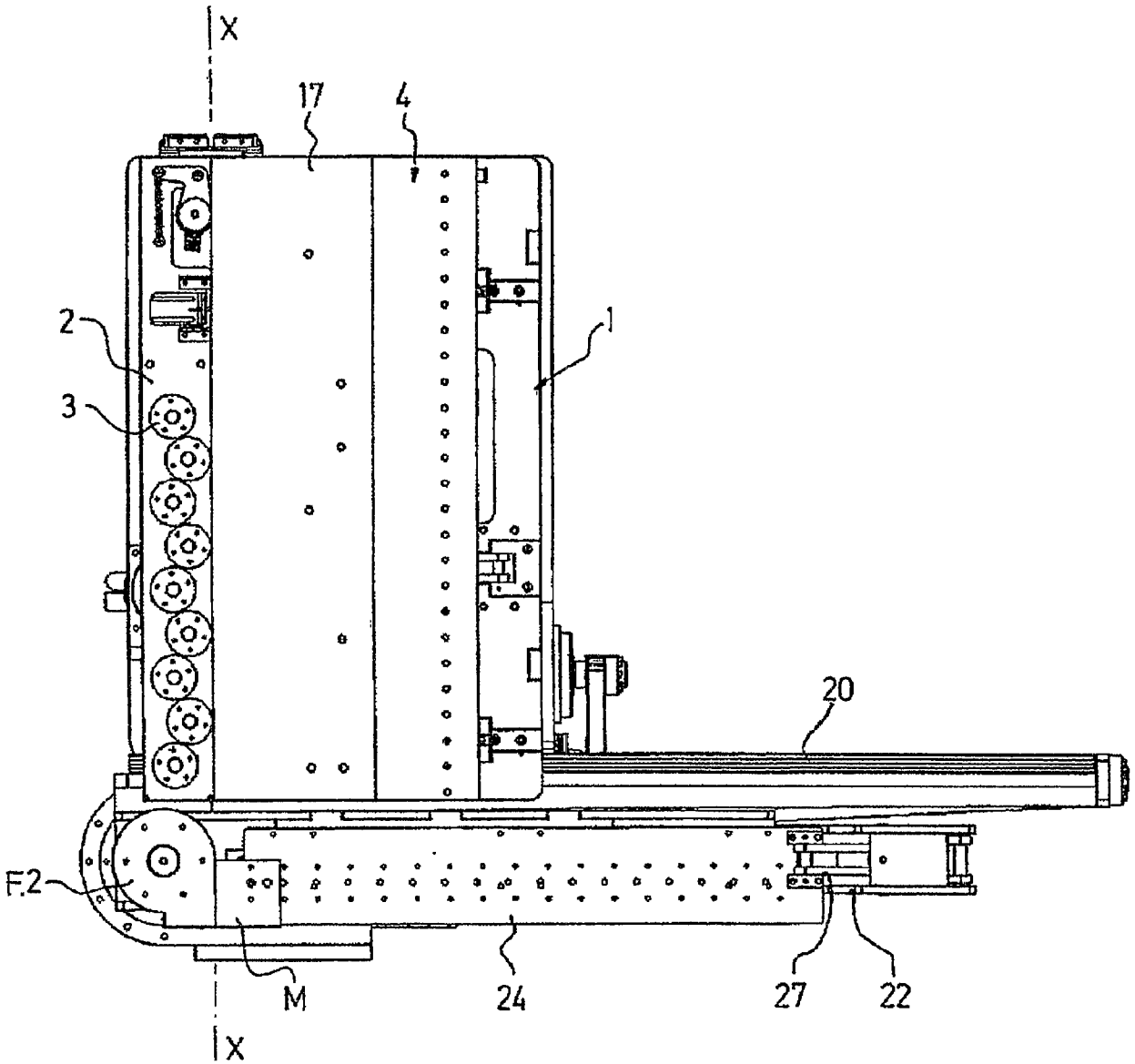
Figure 12:
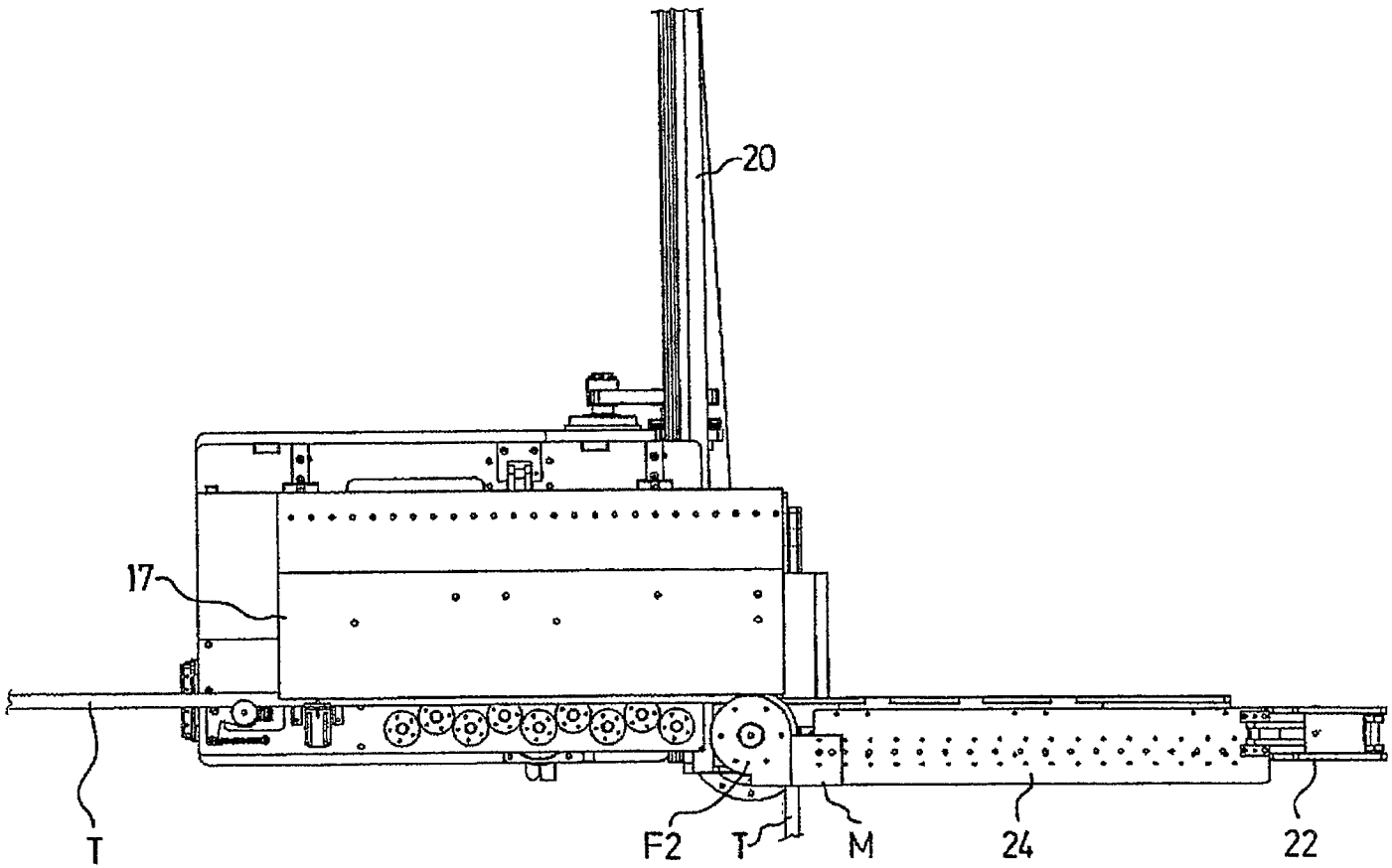
Figure 13:
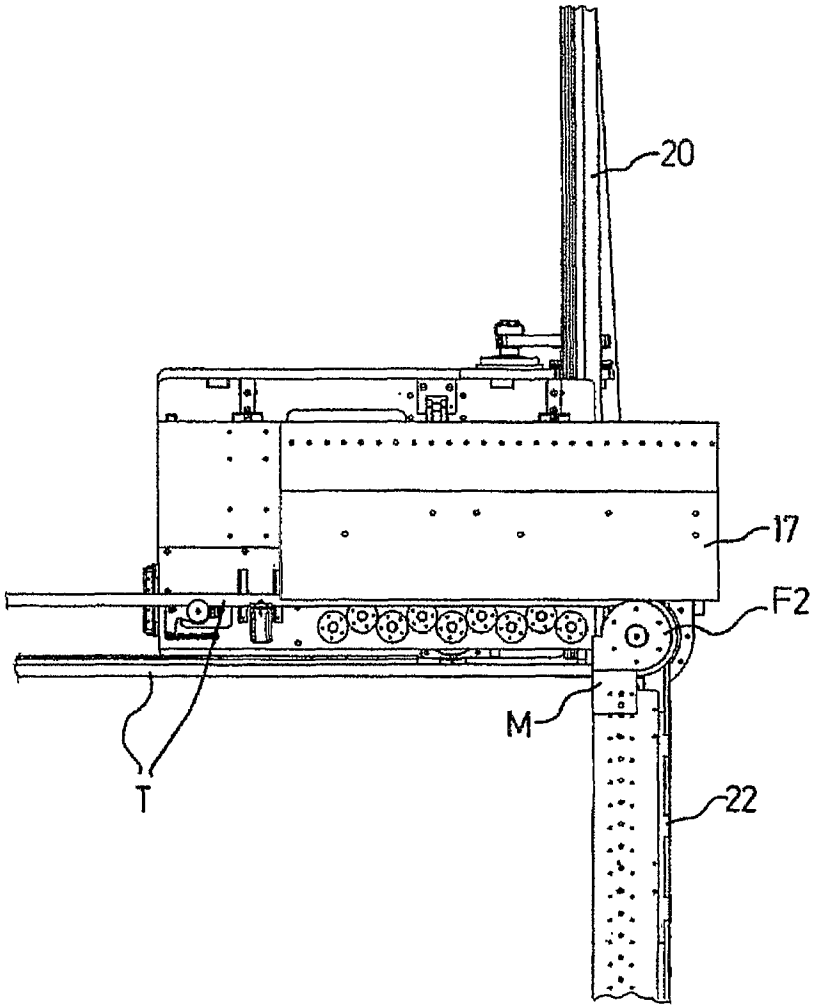

Other characteristics, objects and advantages of the invention will become apparent from the following detailed description with reference to the accompanying drawings which show, by way of non-limitative example, a preferred embodiment thereof. In the drawings:

FIGS. 1, 1*a* and 1*b* are three explanatory diagrams illustrating the design principle of the bending machine according to the invention, FIG. 2 is a front perspective view of the bending machine according to the invention equipped with means for bending by rolling, shown without frame and feeder unit, FIG. 3 is a full perspective view of the bending machine according to the invention, viewed at an angle offset by 90 degrees relative to that of FIG. 2, FIG. 4 is a rear perspective view of the bending machine according to the invention equipped with means for bending by rolling, shown without feeder unit, FIG. 5 is a top view of the bending machine equipped with means for bending by rolling, shown without feeder unit, FIG. 6 is a top view similar to FIG. 5 showing the bending machine at the start of bending of a tube by the rolling method, FIG. 7 is a perspective view of the bending machine according to the invention equipped with means for bending by winding including a first clamping form, shown without feeder unit, FIGS. 8 to 10 are top views of the bending machine of FIG. 7, showing three successive positions of the bending means during bending of a profile section, FIG. 11 is a top view of the bending machine according to the invention equipped with means for bending by winding including a second clamping form, shown without feeder unit, and FIGS. 12 and 13 are top views of the bending machine of FIG. 11 showing two successive positions of the bending means during bending of a profile section.

The bending machine according to the invention, shown by way of example in the figures, consists of a bending machine for the production of U-shaped tubes particularly suitable for the manufacture of heat-exchangers such as nuclear exchangers.

It will be noted that, with a view to simplifying the following detailed description, the bending machine is described in its usual position of use wherein, in particular, the axis of bending (z) is a vertical axis and the axis of movement (x) of the profile sections is a horizontal axis. Consequently, the terms vertical, horizontal, etc. refer to such a position.

The bending machine according to the invention includes, in the first place, a frame 1 on the horizontal upper face of which is disposed a fixed side plate 2 whereon are positioned a first series of gears 3 aligned along an axis parallel to the axis (x) of movement of the profiles T to be bent, actuated by a gear motor 11, and adapted to rotatably drive a first set of rollers G1-Gn which in this example are five in number.

The bending machine also includes, mounted on the upper face of the frame 1, a horizontal platen 4 capable of being moved along a horizontal axis (y) orthogonal to the axis of movement (x), and equipped for this purpose with slides 5 secured on the underside of the said platen and designed to slide along rails 6 integral with the frame 1.

This platen 4 additionally presents, facing the plate 2 and extending in the same horizontal plane as the latter, a side strip 8 whereon are positioned a second series of gears 9 extending opposite the first gears 3, actuated by a gear motor 10 and adapted to rotatably drive a second, so-called mobile, series of rollers G'1-G'n which in this example are also five in number.

The platen 4 is additionally associated with a toggle joint system 7 designed to move along the axis (y) between a position for clamping and entraining a profile section T to be bent between the two series of driving rollers G1-G5,-G'1 G'5, and a position for introducing a profile section T to be bent between the said series of driving rollers.

The bending machine also includes a mounting plate 12 disposed on the platen 4, capable of being moved relative to the said platen, along a horizontal axis parallel to the axis of movement (x), and equipped for this purpose with slides 13 integral with the underside of the said mounting plate, designed to slide along rails 14 integral with the upper surface of the platen 4.

Furthermore, the mounting plate 12 is associated with a rack and pinion system 15 capable of generating the translational movements thereof.

The mounting plate 12 is positioned so as to be juxtaposed with the side strip 8 of the platen 4, and is adapted to carry a rail 17 for guiding the profiles T positioned so as to extend:

in the same plane as that in which the rollers G1-G5, G'1-G'5 lie, partially above the gears 9 for actuating the mobile series of rollers G'1-G'5 after dismounting the said mobile series of rollers.

The bending machine according to the invention additionally includes a horizontal bending arm 19 positioned along one of the front faces of the frame 1, and including two arms 20, 22: a rotatably fixed arm 20, and a rotary arm 22 articulated relative to the said rotatably fixed arm about a rotary shaft 40 extending along a vertical axis of rotation (z), integral with the vertically disposed drive shaft of a motor 23.

In addition, the rotatably fixed arm 20 is mounted on the frame 1 via a ball screw system 21 capable of moving the arm 20 and therefore the bending arm 19 along a horizontal axis of movement (y) perpendicular to the plane (x, z), in order to adjust the position of the axis of rotation (z) relative to that of the longitudinal axis (x), The rotary arm 22 includes a plate 24 provided with means 29 of indexing the position of a clamping jaw M, the said plate extending longitudinally on the said rotary arm so that it can be moved horizontally in translation relative to the axis of rotation (z), between:

a position nearer to the axis of rotation (z), for clamping and winding a profile T to be bent between the clamping jaw M and a clamping form F1, F2 rotatably integral with the rotary shaft 40, and a position further away from the axis of rotation (z), for introducing a profile to be bent between the clamping jaw M and the clamping form F1, F2.

To facilitate these translational movements, the plate 24 includes, on the underside, slides such as 25 capable of sliding along rails 26 integral with the rotary arm 22.

In addition, the plate 24 is associated with a toggle joint system 27 actuated by a cylinder 28 designed to move it between its two positions nearer to and further away from the axis of rotation (z).

The bending machine described above is designed to provide two distinct configurations enabling two different bending methods to be put into effect.

The first configuration is shown in FIGS. 1*a* and 2 to 6 and provides a bending machine designed to put into effect the technique of bending by rolling or pushing, normally used for bend radii greater than 10 times the diameter of the tubes.

In this configuration the bending machine is equipped, on one hand, with two series of rollers G1-G5 and-G'1 G'5 meshing with the gears 3 and 9 and, on the other hand, a free roller GI mounted freely rotatable on the rotary shaft 40.

In addition, before bending, the position of the freely-rotating roller GI, regulated by transverse movement of the bending arm 19 by means of the ball screw 21, enables the bend radius of the profiles T to be adjusted.

Then, during bending, advancement of the profile T is obtained by means of two series of rollers G1-G5 and G'1-G'5 driven in rotation by the gears 3, 9 and the gear-motors 10 and 11.

The second configuration is shown in FIG. 1*b* and respectively in FIGS. 7-10 and 11-13 and provides a bending machine designed to put into effect the technique of bending by winding, normally used for small bending radii (less than 10 times the diameter of the tubes) or, conversely, for very large bending radii.

In this configuration the bending machine is equipped, on one hand, with a clamping form of large diameter F1 (FIGS. 7 to 10) or small diameter F2 (FIGS. 11 to 13), integral in rotation with the rotary shaft 40 and of which the diameter determines the bend radius of the profiles T, and a clamping jaw M positioned on the rotary arm 22 of the bending arm 19 so as to cooperate with the clamping form and, on the other hand, a guide rail 17 positioned on the mounting plate 12 after dismounting the mobile series of rollers G'1-G'5 and optionally, as shown in FIGS. 7-13, the other series of rollers G1-G5.

In addition, before bending, the transverse position of the bending arm 19 is adjusted so as to align the conduit for clamping and winding the profiles T delineated by the opposing bearing surfaces of the clamping form F1 or F2 and the clamping jaw M along the longitudinal axis (x).

Then, during bending, the profile T is clamped and wound between the form F1 or F2 and the clamping jaw M driven in rotation by the motor 23. Also, the guide slide 17 is moved by means of the rack and pinion system 15 at a rate of advance controlled by that of the profiles T.

The bending machine according to the invention also includes a unit 30 for feeding the profiles T to be bent, positioned upstream of the frame 1 and comprising, in the first place, a V-shaped guide 31.

Additionally and most importantly, the feeder unit 30 includes two rollers 32, 33 each driven in rotation by a gear motor 34, 35, and associated with opening means comprising a cylinder 36 capable of moving the said rollers between a position for clamping and entraining a profile T to be bent and a position for introducing a profile to be bent between the said rollers.

Such a feeder unit 30 constitutes a loader enabling each profile T to be advanced until it is taken up by the driving rollers G1-G5 and-G'1 G'5 or by a combination of clamping form F1, F2 and clamping jaw M.

The bending machine according to the invention additionally includes, mounted on the frame 1, a V-shaped guide 37, a codewheel 38 adapted to travel over the outside of the profile T without slipping and designed in particular to control the advance of the profile T, and a sensor 39 for detecting the end of the said profile.

The bending machine according to the invention therefore has two distinct configurations making it possible to cover, with a single bending machine, a wide range of bending radii of profile sections T, and thus capable of producing with a single bending installation (feeding, bending, unloading, etc.) the full range of U-tubes required for the manufacture of a heat exchanger.

The invention claimed is:

1. A bending machine for the production of bent profile sections, the bending machine comprising:

a frame;

a means for holding the profile sections along a longitudinal axis of movement, wherein the means for holding is mounted on the frame;

a bending means for bending said profile sections, wherein the bending means is mounted on the frame, the bending means include an articulated arm, the articulated arm includes a rotatably fixed arm and a rotary arm, the rotary arm is articulated with respect to said rotatably fixed arm about a rotary shaft extending along an axis of rotation orthogonal to the axis of movement, the rotatably fixed arm is mounted on the frame via a means for moving the articulated arm along an axis of transverse movement perpendicular to the plane, and the means for moving is adapted to adjust the position of the axis of rotation relative to that of the longitudinal axis; and a means for attaching a clamping jaw carried by a means for translational movement of said clamping jaw relative to the axis of rotation, along an axis perpendicular to said axis of rotation, between a position nearer to the axis of rotation, and in a position further away from the axis of rotation;

a means for rotatably driving the rotary shaft of the articulated arm about the axis of rotation;

a means for mounting on the rotary shaft of the articulated arm either a roller freely rotatable relative to said rotary shaft or a clamping form rotatably fixed relative to said rotary shaft;

a means for translationally entraining and guiding a profile section of said profile sections along the longitudinal axis, wherein said means for translationally entraining and guiding includes driving rollers;

a means of mounting the driving rollers is adapted to distribute the driving rollers into two series positioned on either side of the longitudinal axis, a means for translationally moving one of said series of driving rollers along an axis perpendicular to the longitudinal axis, between a position for clamping and entraining a profile to be bent between the two series of driving rollers, and in a position for introducing a profile to be bent between said series of driving rollers; and a means for actuating the driving rollers adapted to rotatably actuate the driving rollers synchronously in the driving rollers position for clamping and entraining a profile to be bent.

2. The bending machine according to claim 1, further comprising:

a means for guiding the profile sections along the longitudinal axis, adapted to cooperate with a clamping form carried by the rotary shaft of the articulated arm and a clamping jaw carried by the rotating portion of said articulated arm;

a rail having a longitudinal bearing surface for guiding a profile section;

a means for mounting the rail on the frame; and a means for translationally moving the rail along a longitudinal axis parallel to the axis.

3. The bending machine according to claim 2, wherein the means for actuating the driving rollers include two series of gears rotatably mounted on the frame, and the bending machine further comprising:

a means for rotatably driving said gears in synchronism.

4. The bending machine according to claim 2, wherein the means for attaching a clamping jaw on the rotary portion of the articulated arm include a mounting plate provided with members for indexing the position of said clamping jaw, and the bending machine further comprising:

a means for translationally moving the clamping jaw relative to the axis of rotation including a toggle joint system connecting the mounting plate to the rotary portion of the articulated arm.

5. The bending machine according to claim 2, further comprising:

a code wheel for determining the length of advancement of the profile sections; and a sensor for detecting the end of said profile sections.

6. The bending machine according to claim 2, wherein the means for translationally moving the one of said series of rollers include a platen mounted on the frame via a means for moving said platen along an axis perpendicular to the longitudinal axis, and the bending machine further comprising:

a means for mounting the rail adapted to position the rail in the same plane as that in which the driving rollers lie.

7. The bending machine according to claim 6, wherein the means for mounting the rail are adapted to position the rail so that the rail extends partially above the gears for actuating the one of said series of rollers after dismounting said one of said series of driving rollers.

8. The bending machine according to claim 7, wherein the means for attaching a clamping jaw on the rotary portion of the articulated arm include a mounting plate provided with members for indexing the position of said clamping jaw, and the bending machine further comprising:

a means for translationally moving the clamping jaw relative to the axis of rotation including a toggle joint system connecting the mounting plate to the rotary portion of the articulated arm.

9. The bending machine according to claim 7, further comprising:

a code wheel for determining the length of advancement of the profile sections; and a sensor for detecting the end of said profile sections.

10. The bending machine according to claim 6, wherein the means for actuating the driving rollers include two series of gears rotatably mounted on the frame, and the bending machine further comprising:

a means for rotatably driving said gears in synchronism.

11. The bending machine according to claim 6, wherein the means for attaching a clamping jaw on the rotary portion of the articulated arm include a mounting plate provided with members for indexing the position of said clamping jaw, and the bending machine further comprising:

a means for translationally moving the clamping jaw relative to the axis of rotation including a toggle joint system connecting the mounting plate to the rotary portion of the articulated arm.

12. The bending machine according to claim 6, further comprising:

a code wheel for determining the length of advancement of the profile sections; and a sensor for detecting the end of said profile sections.

13. The bending machine according to claim 1, wherein the means for actuating the driving rollers include two series of gears rotatably mounted on the frame, and the bending machine further comprising:

a means for rotatably driving said gears in synchronism.

14. The bending machine according to claim 13, wherein the means for mounting the rail are adapted to position the rail so that the rail extends partially above the gears for actuating the one of said series of rollers after dismounting said one of said series of driving rollers.

15. The bending machine according to claim 13, wherein the means for attaching a clamping jaw on the rotary portion of the articulated arm include a mounting plate provided with members for indexing the position of said clamping jaw, the bending machine further comprising:

a means for translationally moving the clamping jaw relative to the axis of rotation including a toggle joint system connecting the mounting plate to the rotary portion of the articulated arm.

16. The bending machine according to claim 13, further comprising:

a code wheel for determining the length of advancement of the profile sections; and a sensor for detecting the end of said profile sections.

17. The bending machine according to claim 1, wherein the means for attaching a clamping jaw on the rotary portion of the articulated arm include a mounting plate provided with members for indexing the position of said clamping jaw, and the bending machine further comprising:

a means for translationally moving the clamping jaw relative to the axis of rotation including a toggle joint system connecting the mounting plate to the rotary portion of the articulated arm.

18. The bending machine according to claim 17, further comprising:

a code wheel for determining the length of advancement of the profile sections; and a sensor for detecting the end of said profile sections.

19. The bending machine according to claim 1, further comprising:

a code wheel for determining the length of advancement of the profile sections; and a sensor for detecting the end of said profile sections.

20. The bending machine according to claim 1, further comprising:

a feeder unit disposed upstream of the frame, wherein the feeder unit comprising:

two rollers for entraining the profile sections, and an opening means capable of moving said rollers between a position for clamping and entraining a profile section to be bent and in a position for introducing a profile section to be bent between said rollers.

* * * * *